US011369212B2

(12) United States Patent
Fusco et al.

(10) Patent No.: US 11,369,212 B2
(45) Date of Patent: Jun. 28, 2022

(54) COLLAPSIBLE PLAYARD

(71) Applicant: SUMMER INFANT (USA), INC., Woonsocket, RI (US)

(72) Inventors: Michael Thomas Fusco, Greenville, RI (US); Anthony Carbone, Harrisville, RI (US); Sean Foster, West Warwick, RI (US); Dana E. Chicca, Somerset, MA (US); Paul Macphail Brown, Slatersville, RI (US)

(73) Assignee: SUMMER INFANT (USA), INC., Woonsocket, RI (US)

( * ) Notice: Subject to any disclaimer, the term of this patent is extended or adjusted under 35 U.S.C. 154(b) by 0 days.

(21) Appl. No.: 16/405,715

(22) Filed: May 7, 2019

(65) Prior Publication Data

US 2020/0352352 A1 Nov. 12, 2020

(51) Int. Cl.

*A47D 13/06* (2006.01)
*A47D 7/00* (2006.01)
*A47D 11/00* (2006.01)

(52) U.S. Cl.

CPC ..... *A47D 13/063* (2013.01); *A47D 7/002* (2013.01); *A47D 13/06* (2013.01); *A47D 13/061* (2013.01); *A47D 13/068* (2013.01); *A47D 11/007* (2013.01)

(58) Field of Classification Search

CPC .... A47D 13/063; A47D 13/06; A47D 13/061; A47D 13/068; A47D 11/007; A47D 7/002; A47D 9/00; A47D 9/005

See application file for complete search history.

(56) References Cited

U.S. PATENT DOCUMENTS

2008/0189854 A1* 8/2008 Thorne ..... A47D 13/061 5/99.1
2009/0188039 A1* 7/2009 Shan ..... A47D 9/00 5/93.1
2010/0162484 A1* 7/2010 Thomas ..... A47D 13/063 5/93.2
2010/0229301 A1* 9/2010 Arnold, IV ..... A47D 9/02 5/93.2
2016/0338506 A1* 11/2016 Yang ..... A47D 13/063
2018/0192785 A1* 7/2018 Horst ..... A47D 13/06

FOREIGN PATENT DOCUMENTS

EP 0428238 A2 * 5/1991 ..... A47D 13/063

OTHER PUBLICATIONS

"Free." Merriam-Webster, Merriam-Webster, www.merriam-webster.com/dictionary/free.*

* cited by examiner

*Primary Examiner* — David R Hare
*Assistant Examiner* — Madison Emanski
(74) *Attorney, Agent, or Firm* — Adler Pollock & Sheehan P.C.

(57) ABSTRACT

A system includes a support frame of a foldable playard, and bassinet fabrics attached to the support frame of the playard. The support frame includes a central hub and a plurality of rods, each of the rods having a first end pivotably attached to the central hub and a second, free end opposite the first end. The support frame is configured to enable the bassinet fabrics to fold with the foldable playard.

8 Claims, 7 Drawing Sheets

COLLAPSIBLE PLAYARD

BACKGROUND OF THE INVENTION

The present invention relates generally to child enclosures, and more particularly to a collapsible playard.

Formerly known as "playpens," playards generally provide a safe space for a baby or toddler to play when one needs kid-free time to cook dinner, get ready for work, or take a bathroom break. Generally rectangular and made from mesh, playards sit directly on or slightly elevated off the floor and are typically designed for easy transport.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one aspect, the invention features a system including a support frame of a foldable playard, bassinet fabrics attached to the support frame of the playard, and a hub system attached to the support frame and configured to enable the attached bassinet fabrics to fold with the foldable playard.

In another aspect, the invention features a system including a support frame of a foldable playard, bassinet fabrics attached to the support frame of the playard, and a hub system attached to the support frame and configured to enable the attached bassinet fabrics to fold with the foldable playard the hub system including a central hub and a metal rods attached to an outer diameter of the central hub.

In still another aspect, the invention features a method including providing a playard, and enabling a support frame and bassinet fabrics to fold with the playard.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
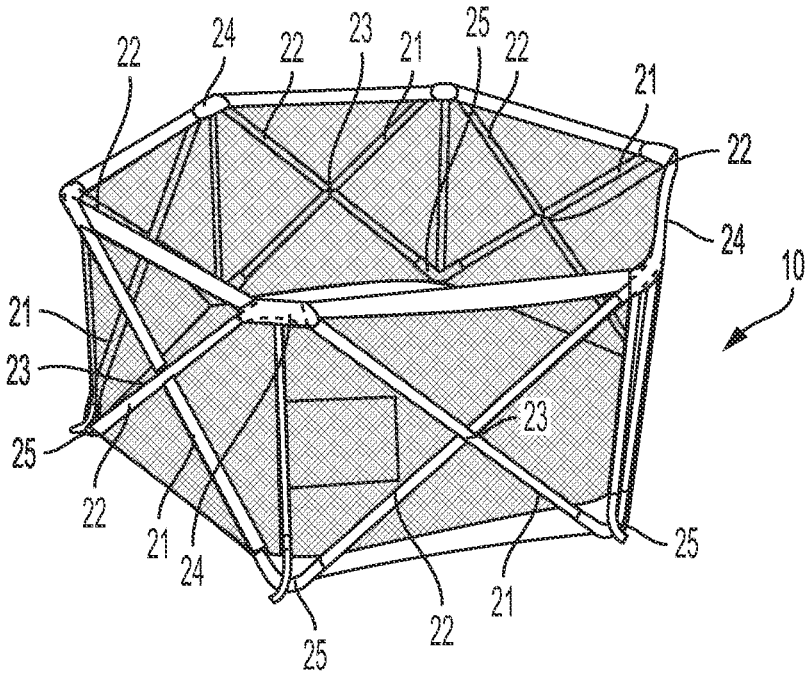
FIG. 1 is a perspective view of a playard in its upright, uncollapsed, position.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Figure 2:
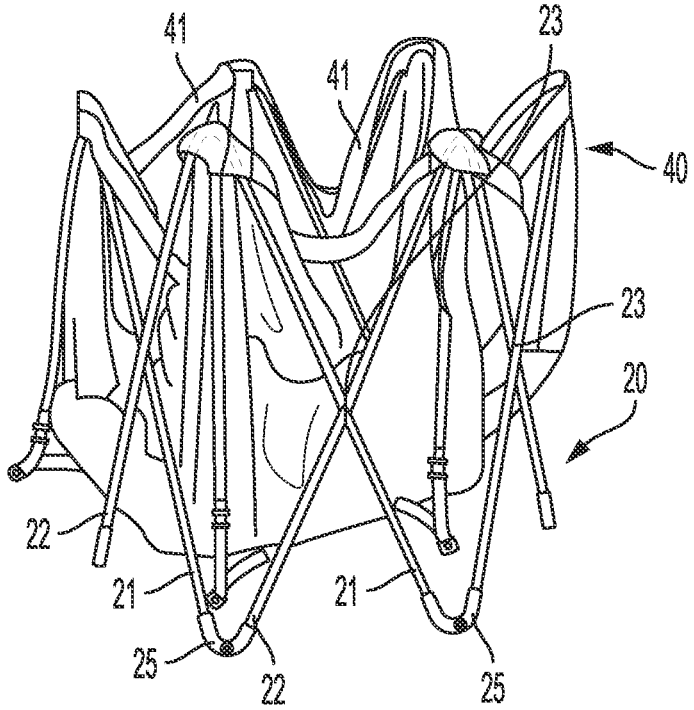
FIG. 2 is a perspective view of the playard of FIG. 1 in a partially collapsed position.

As shown in FIG. 1 and FIG. 2, an exemplary folding playard 10 includes at least a frame 20, and a fabric enclosure 40 mounted on the frame 20. The frame 20 is composed of an array of scissoring tube pairs 21, 22 making up at least four sides. These pairs of tubes 21, 22 are connected in a middle with a hinge pin 23. Preferably, the tubes 21, 22 are hollow and made of steel. Alternative materials for the tubes include aluminum, wood, resin-matrixed carbon fiber, fiberglass, resin-matrixed Teflon® fiber, polycarbonate, ABS, PVC, nylon, and so forth. When the tubes 21, 22 pivot vertically, the height of the playard 10 is increased and the playard 10 collapses as shown in FIG. 2. When the tubes 21, 22 pivot in the horizontal direction, the playard 10 expands and at the tubes' 21, 22 end of travel, the playard 10 is expanded fully and in its use configuration as shown in FIG. 1.

Each of the tube pairs 21, 22 are joined at their top ends and their bottom ends to neighboring, i.e., adjacent, tube pair top and bottom ends by top and bottom knuckle linkages or knuckle hinges, 24 and 25 respectively. Knuckle linkages 24 and 25 are composed of two tube receptacles, joined with at least one hinge that enables the knuckles to pivot vertically, which allows the tube pairs 21, 22 to pivot vertically to a substantially vertical orientation which collapses the horizontal floor of the playard 10 for storing. The hinge is composed of a pair of connected tongue and groove casings and the tongues are formed with aligned holes. The two casings are secured to each other a rivet pin that extends through the aligned holes. The top and bottom knuckle linkages are further composed of two tube receiving sockets which are formed and positioned to receive the ends of tubes 21, 22. Receiving sockets are each formed with rivet openings 33 that receive rivets 36. This secures the ends of the tubes to their receiving sockets. Positioned between receiving sockets and casings are a pair of dog legged shaped spacers one on each side of casings and disposed between the pivot joint and each of the tube receiving sockets, creating a knuckle linkage having a substantially parabolic aspect. Spacer hole are provided in spacers to secure the knuckle linkages to the rail webbing as will be described below. Preferably, the knuckle linkages are composed of rigid plastic, although alternative materials may be used.

Most previous playards and playpens have non-removable fabrics. And for these previous playards and playpens that do have removable fabrics, removal requires a user to unzip sections of the fabric to release the fabrics from a top frame. In contrast, fabric enclosure 40 is removably mounted on the frame 20. More specifically, as described below, the fabric enclosure 40 is held in place on top by canopy/changer plugs while webbing support straps on an underside of the fabrics enclosure 40 are controlled by webbing slide that are snapped onto a bottom of a lower knuckle.

Figure 3:
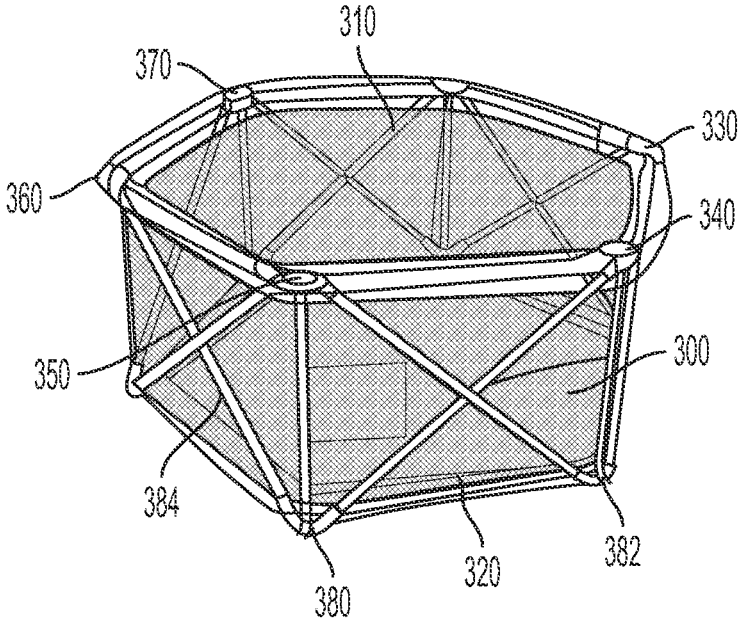
FIG. 3 illustrates a removable fabric enclosure.

As shown in FIG. 3, a fabric enclosure 300 includes a removable top portion 310 and a removable bottom portion 320. The top portion 310 is secured to an upper portion of the playard frame with cover caps 330, 340, 350, 360, 370 that may be removed from matching receptacles in the upper playard frame. When the playard is closed as shown in FIG. 2, the fabric enclosure 300 may be lifted off the upper frame. The removable bottom portion 320 includes tabs at each of the corners of the lower frame, such as tabs 380, 382, 384. Removal of the tabs 380, 382, 384 enable the fabric enclosure 300 to be removed from the playard frame.

Figure 4:
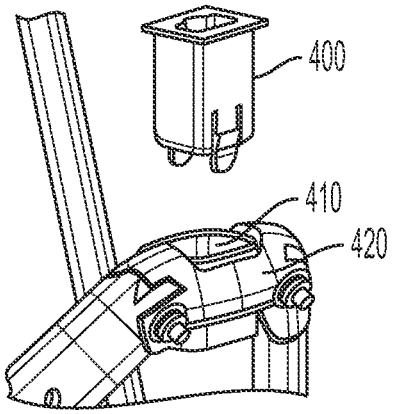
FIG. 4 illustrates a cover cap.

Referring to FIG. 4, a cover cap 400 is shown removed from a corresponding aperture 410 in the removable top portion 420.

Figure 5:
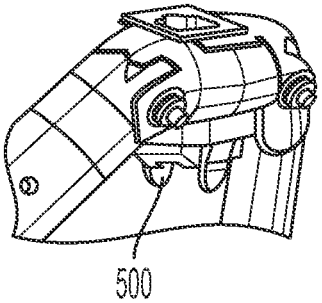
FIG. 5 illustrates a tab.

Referring to FIG. 5, a tab 500 is shown removed from a lower portion of the playard frame.

Figure 6:
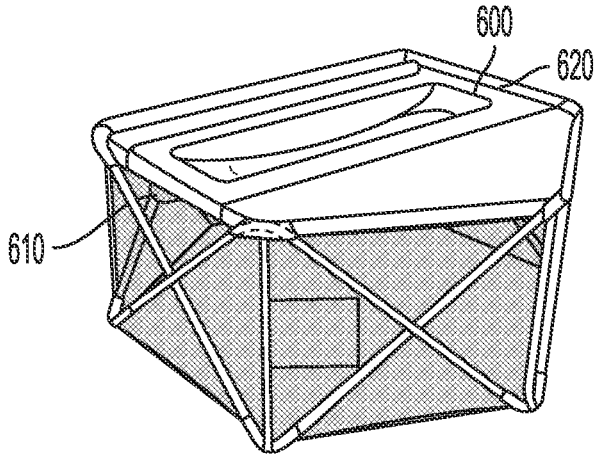
FIG. 6 illustrates a changing accessory.

As shown in FIG. 6, a changing accessory 600 includes a pair of attachment structures 610, 610. The attachment structures 610, 620 snap to corresponding mating posts located on opposing side of the upper frame of the playard. The changing accessory 600 is configured to be easily removed from the playard by disengagement of the attachment structures 610, 620 from the frame.

Figure 7:
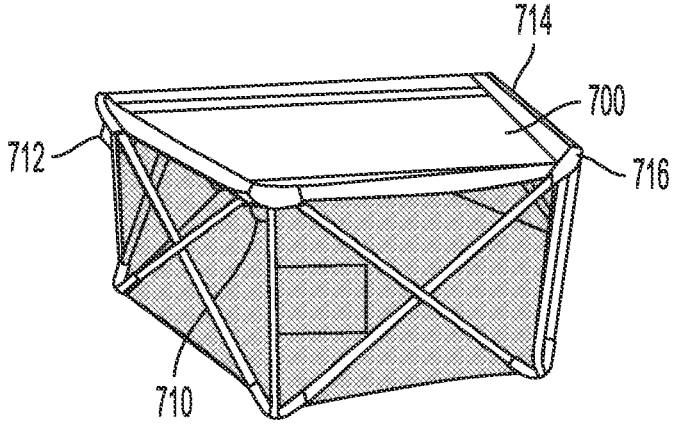
FIG. 7 illustrates a napper.

As shown in FIG. 7, a generally rectangular shaped napper 700 is secured to the four corners of playard with removable plugs 710, 712, 714, 716. A frame knuckle is molded into the frame so that a removable plug can be snapped into the knuckle. The plug has two purposes, i.e., a keyed slot in the center to allow attaching of accessories and a flange around the perimeter that traps the fabric to the frame. The accessory knuckle is a single piece plastic component that is shaped to fit into the keyed slot in the removable plug. In the center of the accessory knuckle is an integrated clip detail that snaps onto a detail in the keyed slot in the removable plug. The user aligns the accessory knuckle with the keyed slot and presses the knuckle into the plug. A distinct snap sound alerts the user that the knuckle is locked in place.

Figure 8:
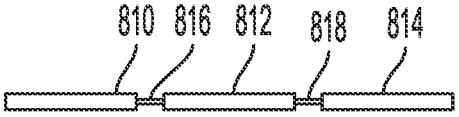
FIG. 8 illustrates a changer frame.

As shown in FIG. 8, each of two opposing sides of the napper 700 include three frame members 810, 812, 814 secures together by shock cords 816, 818. When the napper 700 is removed from the frame of the playard, the frame members may be separated, enabling the user to fold up the napper 700.

Figure 9:
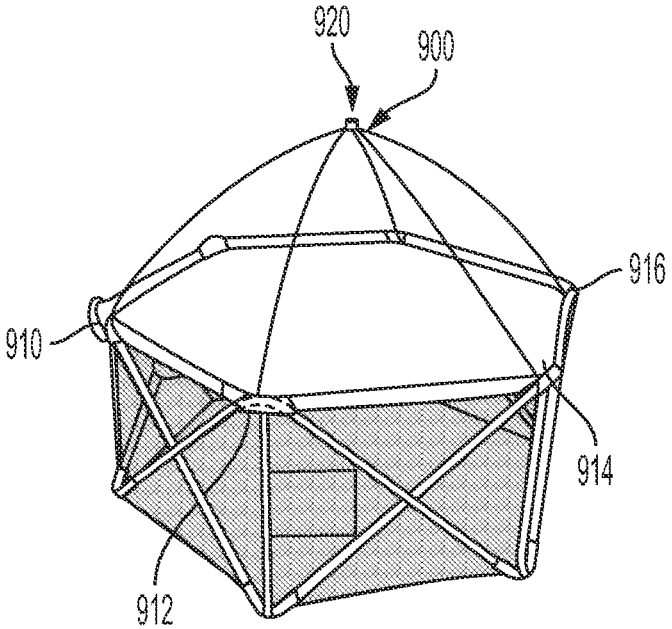
FIG. 9 illustrates a canopy.
Figure 10:
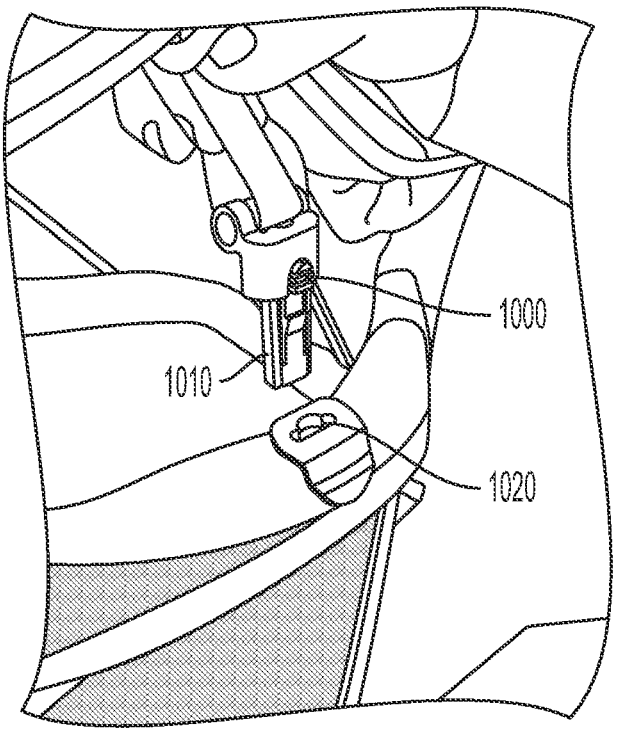
FIG. 10 illustrates a knuckle.

As shown in FIG. 9, the playard may include a canopy 900 that includes canopy stays 910, 912, 914, 916. As shown in FIG. 10, a clip 1000 attaches to an end of a canopy stay 1010 and is inserted into a receptacle 1020 in the top of a knuckle.

Referring back to FIG. 9, the canopy 900 attaches to a top of the playard that is configured to remain in place when the playard is folded. The canopy has clips attached to the bottom ends of the support structure. These clips are all hinged, however two clips, opposite of each other, have a spring loaded pin that prevents the clip from hinging. These two locked out clips are both attached independently to a release cable that runs up the inside of the canopy, and pass through to the exterior though a reinforced hole. The ends of the release cable are then attached to a handle/strap 920.

To operate the canopy fold, the user pulls and twists the handle/strap 920. This pulls the release cable to dis-engage the release pins out of the hinged clips thus allowing the clip to hinge. With the handle/strap still pulled and twisted, the user pushes the canopy down to invert the structure into the canopy toward the floor.

To set-up the canopy, the user grab the handle/strap 920 and lifts the canopy out of the playard. Once the canopy is under tension from support structure it pops into place, and the two opposite sides with the release pins engage back into the hinged knuckles to lock out the canopy.

Figure 11:
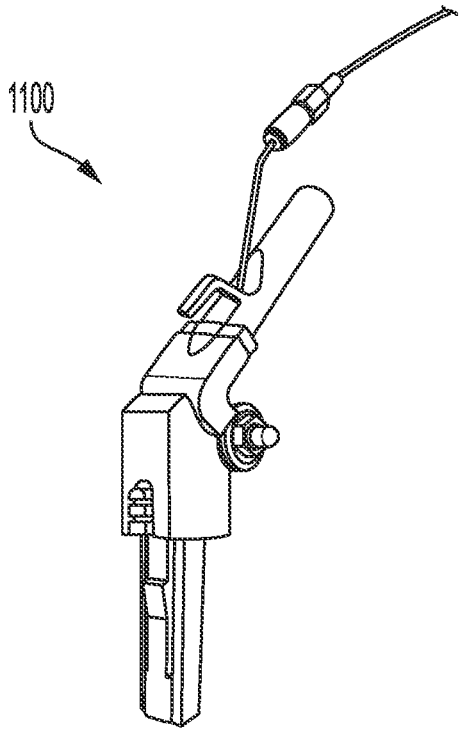
FIG. 11 illustrates the folding canopy clip.

FIG. 11 illustrates the folding canopy clip 1100 wherein the cable is attached to the handle.

Figure 12:
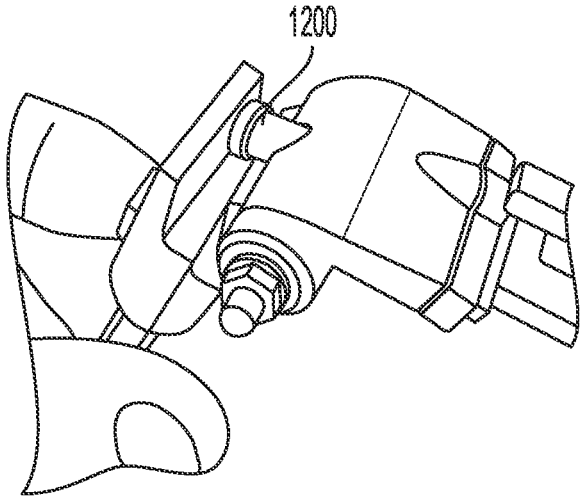
FIG. 12 illustrates a pin.
Figure 13:
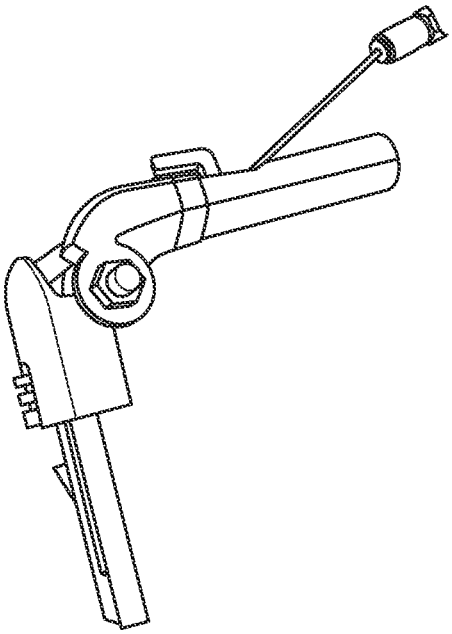
FIG. 13 illustrates a pin.

FIG. 12 illustrates the pin 1200 released out of the hole when fabric handle is pulled and twisted FIG. 13 illustrates how after pin is released the clip can rotate, allowing the canopy to fold.

Figure 14:
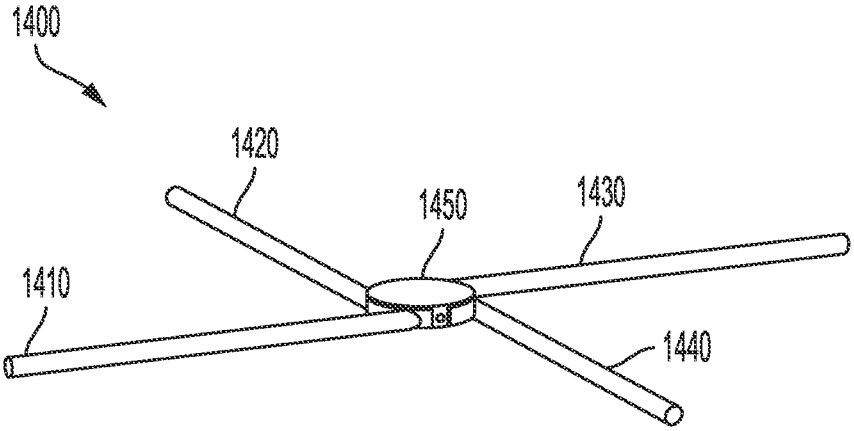
FIG. 14 illustrates an exemplary playard frame in an open state.

Referring now to FIG. 14, an exemplary playard frame 1400 is illustrated in an open state. Most playards require a user to remove bassinet fabrics from a playard frame when it is folded up for travel or storage. The design of the playard frame 1400 enables the support frame and bassinet fabrics to fold with the playard. This reduces the amount of time that is required to set up or tear down the playard. A central hub of the support frame is designed so that the rods are pushed inward when the frame folds. Connection clips for the bassinet fabrics are attached to the main fabrics of the playard so that it is free to move with the main fabrics during the fold.

In addition, the playard frame 1400 meets government standards for bassinets and incline sleep products. More specifically, the playard frame 1400 meets ASTM F2194-16'1 (Standard Consumer Safety Specification for Bassinets and Cradles) and ASTM F3118-17a (Standard Consumer Safety Specification for Infant Inclined Sleep Products).

ASTM F2194-16'1 covers products primarily intended to provide sleeping accommodations for an infant up to approximately 5 months in age or when the child begins to push up on hands and knees, whichever comes first.

ASTM F3118-17a covers a free standing product with an inclined sleep surface primarily intended and marketed to provide sleeping accommodations for an infant up to 5 months old or when the infant begins to roll over or pull up on sides, whichever comes first. It also covers a smaller product intended for newborns up to 3 months old or when newborn begins to wiggle out of position or turn over in the product or weighs more than 15 lb (6.8 kg), whichever comes first. It also covers infant and newborn inclined sleep product accessories, which are attached to, or supported by, another product with the same age or abilities, or both, as the free standing products. If the inclined sleep product can be converted into a product for which another ASTM standard consumer safety specification exists, the product shall meet the applicable requirements of that standard.

The playard frame 1400 includes four metal rods 1410, 1420, 1430, 1440 attached to a central hub 1450 tangentially to an outer diameter of the central hub 1450. The metal rods 1410, 1420, 1430, 1440 are free to fold downward pivoting around an axis. The playard frame 1400 is permanently attached to an underside of the bassinet fabrics by a series of fabric channels that support the metal rods. The bassinet fabrics are connected to the main fabrics of the playard using a series of sewn-in clips that clip over a sewn in webbing detail on the inside of the main fabrics.

Figure 15:
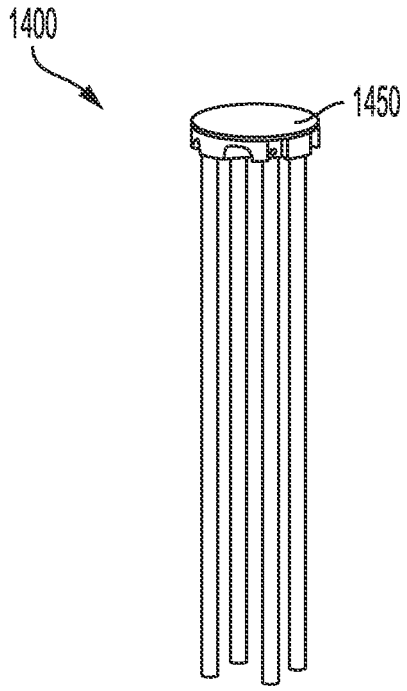
FIG. 15 illustrates an exemplary playard frame in a closed state.

FIG. 15 illustrates the exemplary playard frame 1400 in a closed state.

Figure 16:
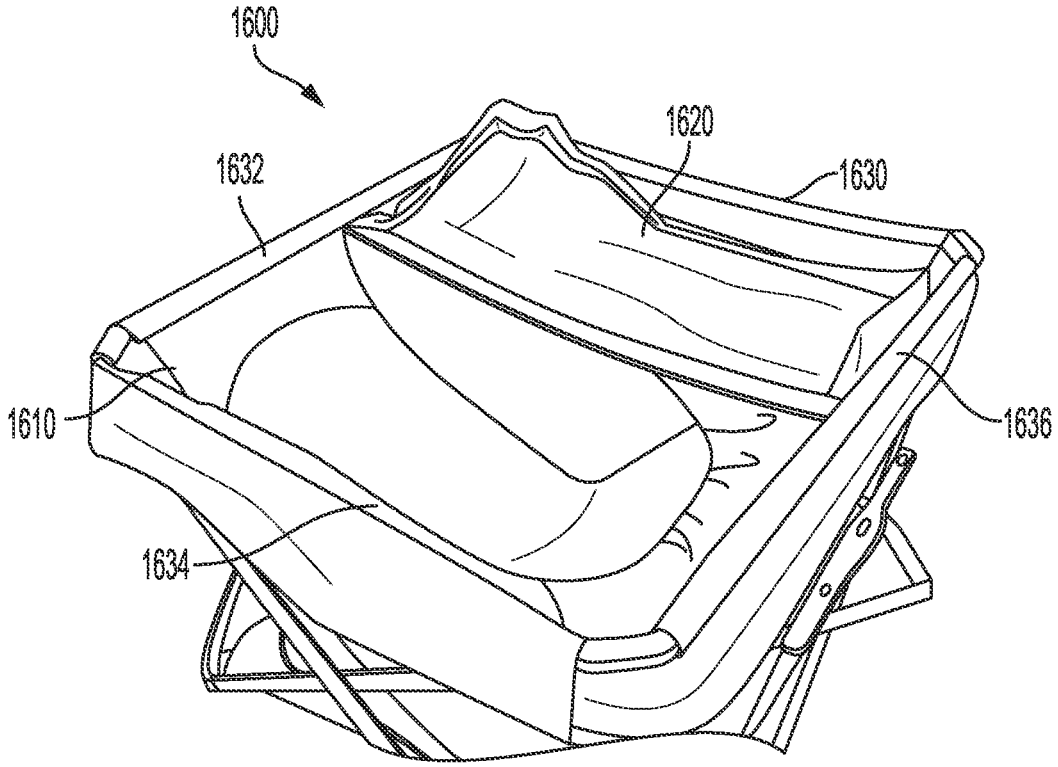
FIG. 16 illustrates an exemplary combination napper/changer.

Now turning to FIG. 16, an exemplary combination napper/changer 1600 is shown. One side of combination napper/changer 1600 is a napper (i.e., inclined sleeper) 1610 while the other side of the combination napper/changer 1600 is a changer 1620. The combination napper/changer 1600 snaps into four upper corner knuckles of the upper frame of the playard. More specifically, The napper/changer 1600 includes four horizontal tubing lengths 1630, 1632, 1634, 1636 with mounting knuckles at a top of at all four corners. Two of the opposing tubes 1630, 1634 are straight with details that allow for mounting of the napper/changer 1600. The other set of opposing tubes 1632, 1636 are made of three pieces (not shown) that can be partially disassembled to allow the napper/changer 1600 to fold. The three pieces interlock with each other to form a rigid structure. They are held tight together by an elastic running up the inside of each tube.

Each of the mounting knuckles have a flexible snap detail on one side that snaps over a detail in a corner knuckle of the playard and a post going downward that helps with alignment. Once aligned, a user presses down on knuckle and a tab snaps over the detail to lock napper/changer 1600 to the frame of the playard.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A method comprising:

providing a foldable playard and a system including bassinet fabrics attached to a removable fabric enclosure of the foldable playard;

a support frame attached to the bassinet fabrics, the support frame including a central hub and a plurality of rods, each of the rods having a first end pivotably attached to the central hub and a second end opposite the first end, wherein the second end of each of the plurality of rods is an unsupported end, the support frame permanently attached to an underside of the bassinet fabrics by a series of fabric channels that support the plurality of rods, the bassinet fabrics connected to the removable fabric enclosure using a series of sewn-in clips that clip over a sewn in webbing detail on an inside of the removable fabric enclosure;

wherein the support frame is configured to enable the bassinet fabrics to fold with the foldable playard; and folding the support frame and bassinet fabrics with the foldable playard.

2. The method of claim 1, wherein folding the support frame includes rotating each of the plurality of rods from a first position in which each of the plurality of rods is parallel to a plane defined by a top surface of the central hub to a second position in which each of the plurality of rods is perpendicular to the plane defined by the top surface of the central hub.

3. A system comprising:

bassinet fabrics attached to a removable fabric enclosure of a foldable playard;

a support frame attached to the bassinet fabrics, the support frame including a central hub and a plurality of rods, each of the rods having a first end pivotably attached to the central hub and a second end opposite the first end, wherein the second end of each of the plurality of rods is an unsupported end, the support frame permanently attached to an underside of the bassinet fabrics by a series of fabric channels that support the plurality of rods, the bassinet fabrics connected to the removable fabric enclosure using a series of sewn-in clips that clip over a sewn in webbing detail on an inside of the removable fabric enclosure; and wherein the support frame is configured to enable the bassinet fabrics to fold with the foldable playard.

4. The system of claim 3 wherein each of the plurality of rods is rotatable from between a first position in which each of the plurality of rods is parallel to a plane defined by a top surface of the central hub, and a second position in which each of the plurality of rods is perpendicular to the plane defined by the top surface of the central hub.

5. The system of claim 3, wherein the central hub is configured so that the rods are pushed inward relative to the central hub when the support frame is folded.

6. The system of claim 3, wherein each of the respective first ends of the rods is tangentially attached to the central hub.

7. The system of claim 3, wherein the plurality of rods includes four rods.

8. The system of claim 3, wherein each of the plurality of rods is formed from a metal.

* * * * *